US010140908B2

(12) United States Patent
Kuo et al.

(10) Patent No.: US 10,140,908 B2
(45) Date of Patent: Nov. 27, 2018

(54) LED DRIVING CIRCUIT AND METHOD

(71) Applicant: MY-SEMI INC., Hsinchu County (TW)

(72) Inventors: Chun-Ting Kuo, Pingtung County (TW); Cheng-Han Hsieh, Hsinchu County (TW)

(73) Assignee: MY-SEMI INC., Hsinchu County (TW)

( * ) Notice: Subject to any disclaimer, the term of this patent is extended or adjusted under 35 U.S.C. 154(b) by 158 days.

(21) Appl. No.: 15/261,117

(22) Filed: Sep. 9, 2016

(65) Prior Publication Data

US 2017/0270845 A1 Sep. 21, 2017

(30) Foreign Application Priority Data

Mar. 18, 2016 (TW) ..... 105108480 A

(51) Int. Cl.
*G09G 3/20* (2006.01)
*G09G 3/32* (2016.01)

(52) U.S. Cl.
CPC ..... *G09G 3/2025* (2013.01); *G09G 3/2077* (2013.01); *G09G 3/32* (2013.01); *G09G 2310/08* (2013.01); *G09G 2320/0233* (2013.01); *G09G 2360/18* (2013.01)

(58) Field of Classification Search
None
See application file for complete search history.

(56) References Cited

U.S. PATENT DOCUMENTS

2005/0156635 A1* 7/2005 Yoneyama ..... G09G 3/32 327/108
2016/0189605 A1* 6/2016 Ahn ..... G09G 3/3225 345/213

* cited by examiner

*Primary Examiner* — Joseph Haley
*Assistant Examiner* — Emily Frank
(74) *Attorney, Agent, or Firm* — Li & Cai Intellectual Property (USA) Office

(57) ABSTRACT

A LED driving circuit comprises a high bit driving circuit, a low bit driving circuit and a driving output terminal. The high bit driving circuit coupled to a high bit signal of the grayscale signal determines a first current continuously driven during a grayscale period according to the value of the high bit signal. The first current is invariant during the grayscale period. The low bit driving circuit coupled to a low bit signal of the grayscale signal determines a second current driven in at least two time intervals during the grayscale period according to the value of the low bit signal. The driving output terminal coupled to the high bit driving circuit and the low bit driving circuit outputs the driving current added by the first current and the second current. Accordingly, the LED display can be improved with higher refresh rate and/or better uniformity in low grayscale.

17 Claims, 10 Drawing Sheets

LED DRIVING CIRCUIT AND METHOD

BACKGROUND

1. Technical Field

The present disclosure relates to a LED driving circuit, in particular, to a LED driving circuit and method.

2. Description of Related Art

The light emitting diode (LED) has become widely used to various displays. Generally, the LED display to define n-bit grayscale means that the grayscale period T is divided into $2^n$ or $(2^n-1)$ grayscale steps, and each grayscale step has a time interval T1, wherein T1=T/($2^n$) or T/($2^n$−1). A value of n-bit grayscale signal D [n−1:0] (referred to as the brightness value) is used to determine how many grayscale steps need to be turn-on (turn-on steps) in one grayscale period to determine the brightness. The grayscale period T may be equal to the frame period Tf, and the frame period Tf may also include the non-turn-on time Toff, wherein Tf=T+Toff.

The refresh rate has become more important because of the rapid development of displays. The turn-on time in one grayscale period can be divided to increase the refresh rate. For example, as shown in FIG. 2A, the conventional current output of 8 turn-on steps is continuous in one grayscale period when the brightness value is D [3:0]=1000. Please refer to FIG. 2B. When the current output of 8 turn-on steps are divided into 4 time intervals during the grayscale period, the refresh rate becomes 4/T and therefore has a fourfold increase compared with the conventional refresh rate. (the refresh rate of the conventional waveform is 1/T).

Conventionally, the driving circuit only provides one constant current I. When the brightness value is lower than the amount of time intervals, the refresh rate cannot be sustained. As shown in FIG. 1, when the brightness value is D [3:0]=0001, the turn-on time cannot be divided because there is only one turn-on step. Thus the refresh rate cannot be sustained.

SUMMARY

An exemplary embodiment of the present disclosure provides a LED driving circuit and method which provides the LED display with a higher refresh rate and/or better uniformity in low grayscale.

According to one exemplary embodiment of the present disclosure, a LED driving circuit used to generate a driving current to drive a LED during a grayscale period according to a grayscale signal is provided. The LED driving circuit includes a high bit driving circuit, a low bit driving circuit and a driving output terminal. The high bit driving circuit coupled to a high bit signal of the grayscale signal determines a first current continuously driven during a grayscale period according to a value of the high bit signal, wherein the first current is invariant during the grayscale period. The low bit driving circuit coupled to a low bit signal of the grayscale signal determines a second current driven in at least two time intervals during the grayscale period according to a value of the low bit signal. The driving output terminal coupled to the high bit driving circuit and the low bit driving circuit outputs the driving current added by the first current and the second current.

According to another exemplary embodiment of the present disclosure, a method of driving a LED used to generate a driving current to drive a LED during a grayscale period according to a grayscale signal is provided, and the method includes the following steps: defining a grayscale signal to be a high bit signal and a low bit signal; determining a first current continuously driven during a grayscale period according to a value of the high bit signal, wherein the first current is invariant during the grayscale period; determining a second current driven in at least two time intervals during the grayscale period according to a value of the low bit signal; and outputting the driving current added by the first current and the second current.

According to yet another exemplary embodiment of the present disclosure, a LED driving circuit used to generate a driving current to drive a LED during a grayscale period according to a grayscale signal is provided. The LED driving circuit generates a driving current during the grayscale period according to the grayscale signal, adjusts an initial current value of the driving current according to a high bit signal of the grayscale signal, and increases the driving current in at least two time intervals according to a low bit signal of the grayscale signal to enable the driving current to be greater than the initial current value in the at least two time intervals. The initial current value is ≥0.

To sum up, a LED driving circuit and method provided by the present disclosure applies two driving circuits to respectively process the turn-on state of different data bits. Accordingly, the LED display can be improved with higher refresh rate and/or better uniformity in low grayscale.

In order to further understand the techniques, means and effects of the present disclosure, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
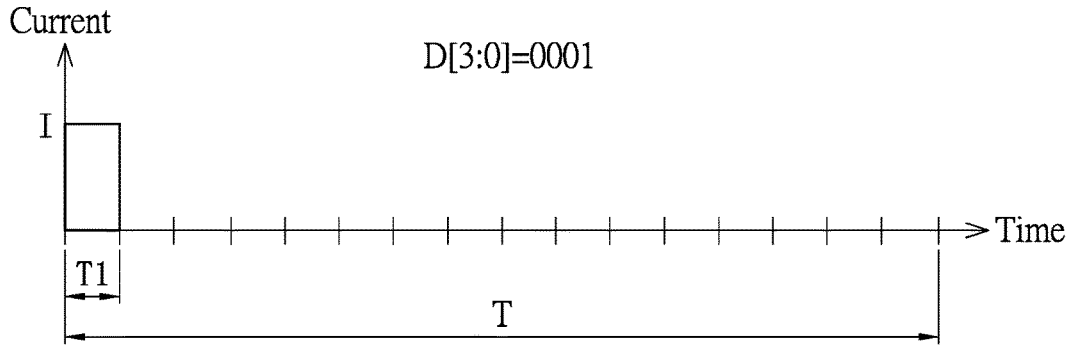
FIG. 1 PRIOR ART
FIG. 1 is a timing diagram illustrating the conventional driving current.
Figure 2A:
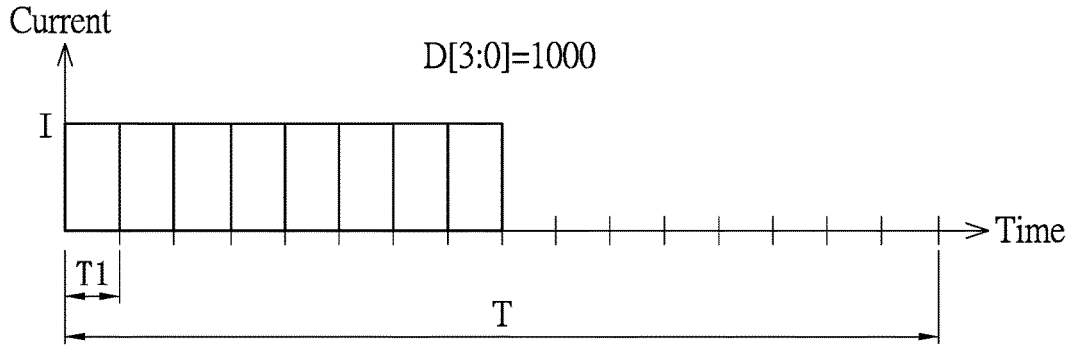
FIG. 2A PRIOR ART
FIG. 2A is a timing diagram illustrating the conventional driving current, wherein the turn-on time is not divided.
Figure 2B:
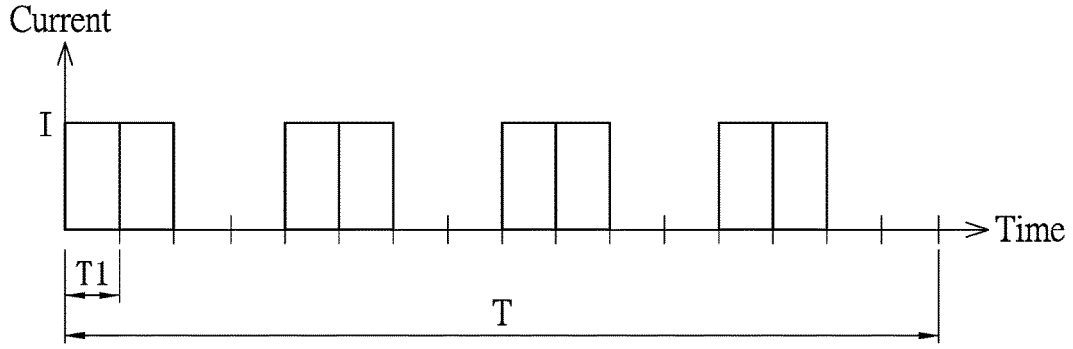
FIG. 2B PRIOR ART
FIG. 2B is a timing diagram illustrating the conventional driving current, wherein the turn-on time is divided.

Reference will now be made in detail to the exemplary embodiments of the present disclosure, examples of which are illustrated in the accompanying drawings. Wherever possible, the same reference numbers are used in the drawings and the description to refer to the same or like parts.

The LED driving circuit provided by the present disclosure generates a driving current to drive a LED during a grayscale period according to a grayscale signal. The LED driving circuit adjusts an initial current value of the driving current according to a high bit signal of the grayscale signal and increases the driving current in at least two time intervals according to a low bit signal of the grayscale signal to enable the driving current to be greater than the initial current value in the at least two time intervals. The initial current value is ≥0. The initial current value is a first current determined by the high bit signal, the low bit signal determines a second current, and the driving current in the at least two time intervals is a summation of the first and second currents. The LED driving circuit of the present disclosure will be described in the following paragraphs.

Figure 3:
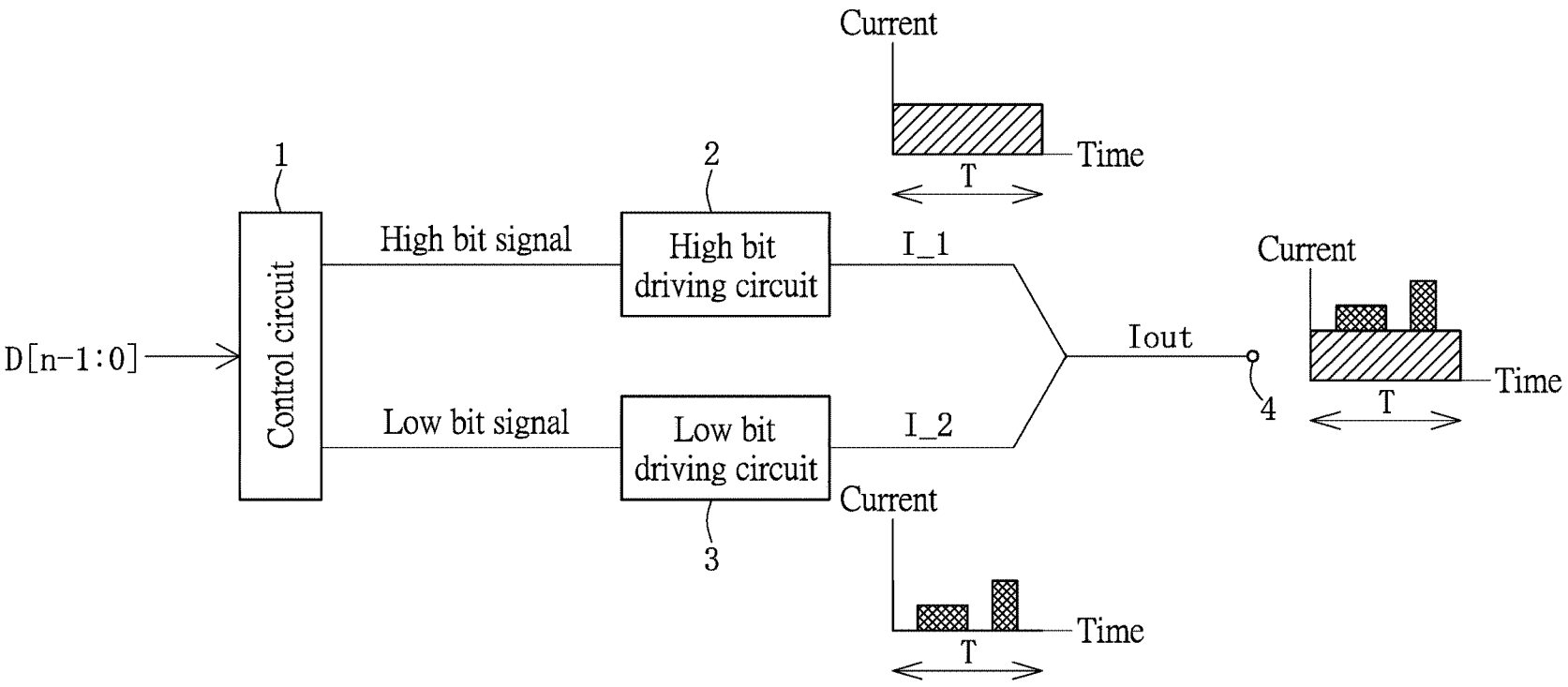
FIG. 3 is a block diagram of the LED driving circuit according to the present disclosure.

Please refer to FIG. 3, which is a block diagram of the driving circuit of the LED in accordance with the present disclosure. The LED driving circuit generates a driving current to drive a LED during a grayscale period according to a grayscale signal. Here, regarding the application of n-bit grayscale, the n-bit is a binary signal used to denote the grayscale signal, wherein n is a positive integer greater than 1. The grayscale signal (or referred as the brightness value) is defined as D [n−1:0] to indicate the grayscale (or brightness) of the LED. The grayscale period T in the frame period Tf is divided into $2^n$ or $(2^n-1)$ grayscale steps, and each grayscale step has a time interval T1, wherein T1=T/($2^n$) or T/($2^n$−1). The grayscale period T applied in the present embodiment is divided into $2^n$ grayscale steps, and T1=T/($2^n$). When the grayscale period T is divided into ($2^n$−1) grayscale steps, T1=T/($2^n$−1). Here, the difference between $2^n$ and ($2^n$−1) is "−1", but the method of setting the grayscale signal is substantially the same. The LED driving circuit includes a control circuit 1, a high bit driving circuit 2, a low bit driving circuit 3 and a driving output terminal 4.

The control circuit 1 receives a grayscale signal D [n−1:0] and generates a high bit signal and a low bit signal. The high bit driving circuit 2 is coupled to the high bit signal of the grayscale signal D [n−1:0]. The low bit driving circuit 3 is coupled to the low bit signal of the grayscale signal D [n−1:0]. The driving output terminal 4 is coupled to the high bit driving circuit 2 and the low bit driving circuit 3. The control circuit 1 transmits the high bit signal to the high bit driving circuit 2, and transmits the low bit signal to low bit driving circuit 3. Here, the high bit signal and the low bit signal are, for example, control signals or bit value, but it is not limited thereto.

The control circuit 1 defines the grayscale signal D [n−1:0] to be the high bit signal and the low bit signal. For example, the high bit signal has k-bits and the low bit signal has (n−k)-bits, wherein k is a positive integer smaller than n, but it is not limited thereto. The high bit signal is D [n−1:n−k] and the low bit signal is D [n−k−1:0]. Regarding the LED brightness, as long as the driving current value and the turn-on time have a same product, the brightness is the same. For example, a pair of grayscale steps (2T1) applied to 10 mA current and a grayscale step (T1) applied to 20 mA current have the same brightness, namely, 10 mA×2T1=20 mA×T1. Generally, the grayscale signal is used to control the LED brightness, and the value of the grayscale signal corresponds to a product of the driving current and the turn-on time. Please refer to FIG. 1. Conventionally, the value of the grayscale signal D [n−1:0] corresponds to the drive time of the constant current I (driving current), that is, the value of the grayscale signal D [n−1:0] is the number of the turn-on steps in one grayscale period.

Compared with the conventional driving method, the high bit driving circuit 2 of the LED driving circuit of the present embodiment determines a first current I_1 continuously driven during the grayscale period T according to the value of the high bit signal D [n−1:n−k], wherein the first current is invariant during the grayscale period T. The low bit driving circuit 2 determines a second current I_2 driven in at least two time intervals during the grayscale period T according to the value of the low bit signal D [n−k−1:0]. The driving output terminal 4 outputs the driving current Iout added by the first current I_1 and the second current I_2. Here, the LED driving circuit shown in FIG. 3 can be feasibly applied to the method of controlling the LED of the present embodiment.

The control circuit 1 of the present disclosure transmits the high bit signal to the high bit driving circuit 2, and transmits the low bit signal to the low bit driving circuit 3. Here, the control circuit 1 may be a shift resistor or other circuit, and the high bit signal and the low bit signal are, for example, a control signal or bit value, but it is not limited thereto.

Figure 4:
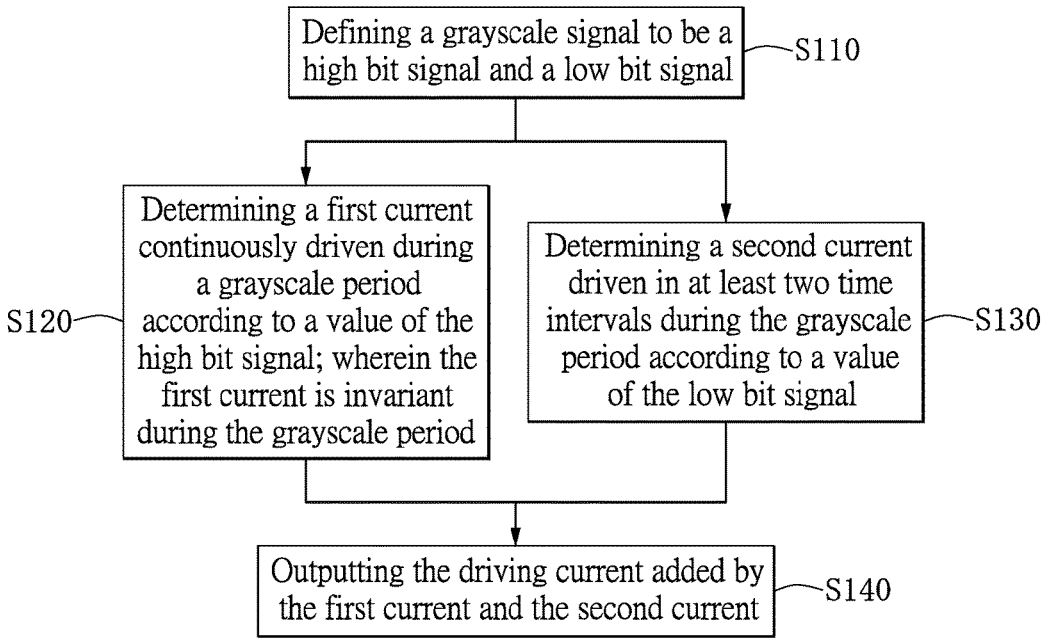
FIG. 4 is a flowchart of the LED driving method of according to the present disclosure.

Please refer to FIG. 4. The method includes the following steps: S110: defining a grayscale signal to be a high bit signal and a low bit signal; S120: determining a first current I_1 continuously driven during a grayscale period according to a value of the high bit signal of the grayscale signal, wherein the first current I_1 is invariant during the grayscale period; S130: determining a second current I_2 driven in at least two time intervals during the grayscale period according to a value of the low bit signal of the grayscale signal; and S140: outputting a driving current Iout added by the first current I_1 and the second current I_2. Compared with the conventional grayscale (or brightness) generated by the grayscale signal D [n−1:0], the present disclosure further sets the driving current Tout value and the turn-on timing to enable the LED to generate the same grayscale (or brightness). Here, S120 and S130 can be executed simultaneously after S110, and the first current I_1 can be determined before/after the second current I_2.

Figure 5A:
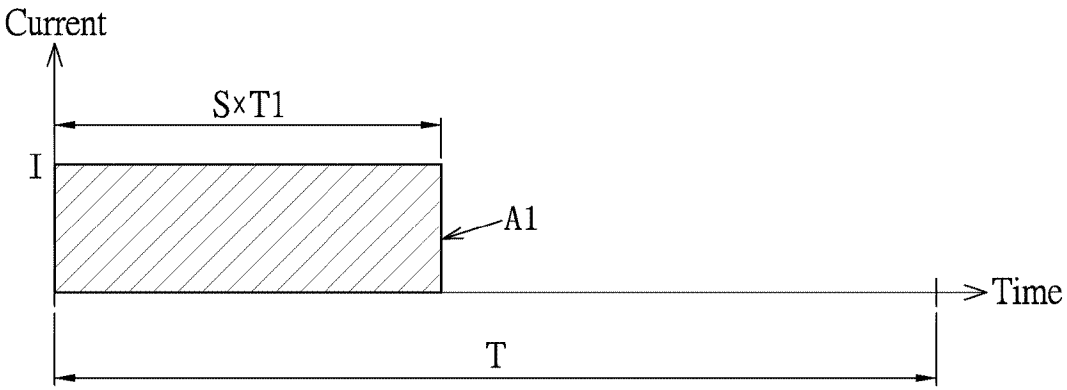
FIG. 5A PRIOR ART
FIG. 5A is a timing diagram illustrating the conventional driving current.

In the present embodiment, the first current I_1 is determined before the second current I_2, but the present disclosure is not limited thereto. According to the conventional LED driving method (applying the constant current I to drive the LED), the value of the grayscale signal D [n−1:0] is S, and the turn-on time of the constant current I is represented by S×T1. Please refer to FIG. 5A. The product of the constant current I and the turn-on time is S×T1×I which is denoted by A1. According to the conventional LED driving method (applying the constant current I to drive the LED), the value of the high bit signal D [n−1:n−k] is m, the value of the low bit signal D [n−k−1:0] is p, S is represented by $m\times2^{(n-k)}+p$ and the product of the constant current I and the time is represented by $(m\times2^{(n-k)}+p)\times T1\times I$. In order to obtain the same grayscale, the driving current Iout of the LED of the present embodiment is divided into the first current I_1 and the second current I_2.

Figure 5B:
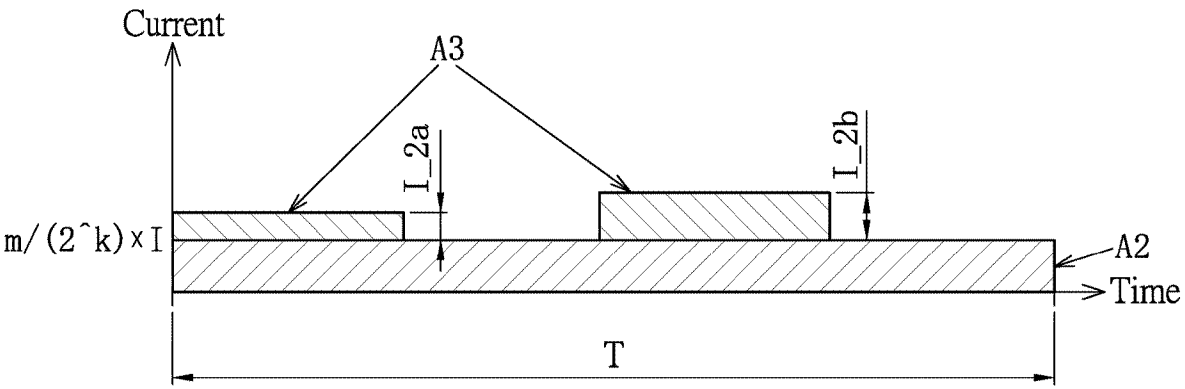
FIG. 5B is a timing diagram illustrating the driving current according to the present disclosure.

On the basis of the conventional LED driving method and the product of the constant current I and the time that is represented by $(m\times2^{(n-k)}+p)\times T1\times I$, the product of the constant current I and the time can be changed to be $m\times2^{(n-k)}\times T1\times I+p\times T1\times I$ if m and p are separated. Thus the value of the first current I_1 is $m/(2^k)\times I$. Please refer to FIG. 5B. The first current I_1 is $m/(2^k)\times I$, and the product of the first current I_1 and the time is $m/(2^k)\times2^n\times T1\times I$ which is denoted as A2. The first current I_1 determines whether to drive the LED during the grayscale period T according to the value of the high bit signal D [n−1:n−k]. When the value of the high bit signal D [n−1:n−k] is 0, the first current I_1 is 0, and when the value of the high bit signal D [n−1:n−k] is >0, the first current I_1 is $m/(2^k)\times I$ during the grayscale period T. It can therefore be found that the first current I_1 varies with the value of the high bit signal D [n−1:n−k]. The greater the value m of the high bit signal D [n−1:n−k] is, the higher the first current I_1 is. In addition, the second current I_2 is driven in at least two time intervals during the grayscale period. As shown in FIG. 5B, the second current I_2 is divided into I_2*a* and I_2*b*, and I_2*a* and I_2*b* can be the same or different. The present disclosure does not limit the number and duration of the time interval. In addition, the present disclosure does not limit the gap in the time intervals and the current magnitude of the second current I_2 in each time interval. The product of the second current I_2 and the time during the grayscale period T is p×T1×I which is denoted as A3 regardless of the number of the time intervals and the current magnitude of the second current I_2 in each time interval. That is, the product of the second current I_2 and the time is p×T1×I. Here, a sum of A2 and A3 according to the present embodiment is equal to A1 according to the conventional LED driving method. However, the present disclosure does not limit that the first current I_1 has to be $m/(2^k)\times I$. When the first current I_1 changes, the second current I_2 changes.

In the present embodiment, the first current I_1 is set to be $m/(2^k)\times I$, and the product of the second current I_2 and the time is set to be p×T1×I. In certain embodiments, the second current I_2 is further set to be $1/(2^k)\times I$, and the total turn-on time of all time intervals of the second current I_2 is the value of the low bit signal$\times2^k\times T1$, that is, $p\times(2^k)\times T1$.

Figure 6:
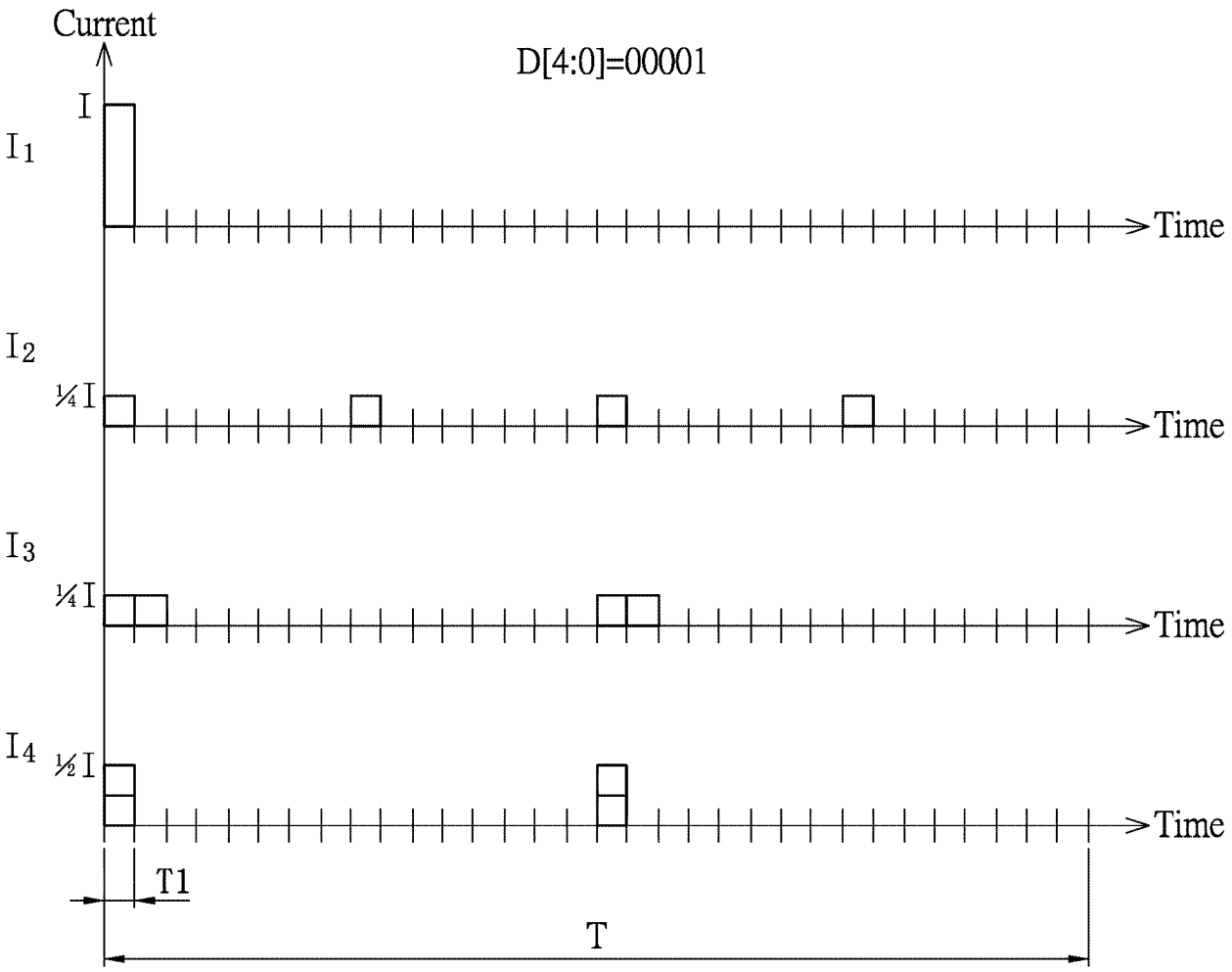
FIG. 6 is a timing diagram illustrating the difference between driving the LED by the driving current based on the grayscale signal D [4:0]=00001 according to the present embodiment and driving the LED by the conventional driving current.

Please refer to FIG. 6, which is a timing diagram illustrating the difference between driving the LED by the driving current based on the grayscale signal D [4:0]=00001 according to the present embodiment and driving the LED by the conventional driving current. When 5-bit grayscale is applied, the two bits D [4:3] (k=2) are defined to the high bit signal and three bits D[2:0] are defined to the low bit signal, and the grayscale period is T and the grayscale step T1 is T/32. When the grayscale signal is D [4:0]=00001, the current sequences $I_2$, $I_3$ and $I_4$ replace the conventional current sequence $I_1$, and the first current I_1 is set to be $m/(2^k)\times I$.

As shown in the current sequence $I_2$, the second current I_2 is set to be $1/(2^k)\times I$. The high bit driving circuit does not generate the driving current during the grayscale period T because of D [4:3]=0, and the low bit driving circuit generates the 1/4×I current equally driven at four T1×1 time intervals during the grayscale period T because of D [2:0]=1. But it is not limited thereto. The position of four time intervals can be changed, and it is not limited by the current sequence $I_2$ shown in FIG. 6. Compared with the conventional current sequence $I_1$, the product of the driving current value and the turn-on time in the current sequence $I_2$ is 1/4×I×T1×4=I×T1, and the brightness of the current sequence $I_2$ is the same as the brightness of the current sequence $I_1$. In addition, the refresh rate of the current sequence $I_2$ has a fourfold increase compared with the refresh rate of the current sequence $I_1$ because the current state of $I_2$ changes four times during the grayscale period T.

As shown in the current sequence $I_3$, the second current I_2 is set to be $1/(2^k)\times I$. When D [4:0]=00001, the high bit driving circuit does not generate the driving current during the grayscale period T because of D [4:3]=0, and the low bit driving circuit generates the 1/4×I current equally driven at two T1×2 time intervals during the grayscale period T because of D [2:0]=1. But it is not limited thereto. The position of the two time intervals can be changed. Compared with the current sequence $I_1$, the product of the driving current value and the turn-on time in the current sequence I3 is 1/4×I×2T1×2=I×T1, and the brightness of the current sequence I3 is the same as the brightness of the current sequence $I_1$. In addition, the refresh rate of the current sequence $I_3$ has a double increase compared with the refresh rate of the current sequence $I_1$. The brightness uniformity of the two time intervals of the current sequence $I_3$ is more uniform than the current sequence $I_2$, because the turn-on time of every time interval of $I_3$ is longer than $I_2$ The second current I_2 is set to be I/2 in the current sequence $I_4$. When D [4:0]=00001, the high bit driving circuit does not generate the driving current during the grayscale period T because of D [4:3]=0, and the low bit driving circuit generates the I/2 current equally driven at two T1×1 time intervals during the grayscale period T because of D [2:0]=1. But it is not limited thereto. The position of the two time intervals can be changed. Compared with the current sequence $I_1$, the product of the driving current value and the turn-on time in the current sequence $I_4$ is 1/2×I×T1×2=I×T1, and the brightness of the current sequence $I_4$ is the same as the brightness of the current sequence $I_1$. In addition, the refresh rate during the grayscale period T has a double increase compared with the current sequence $I_1$ because the current state of $I_4$ changes two times during the grayscale period T.

Figure 7:
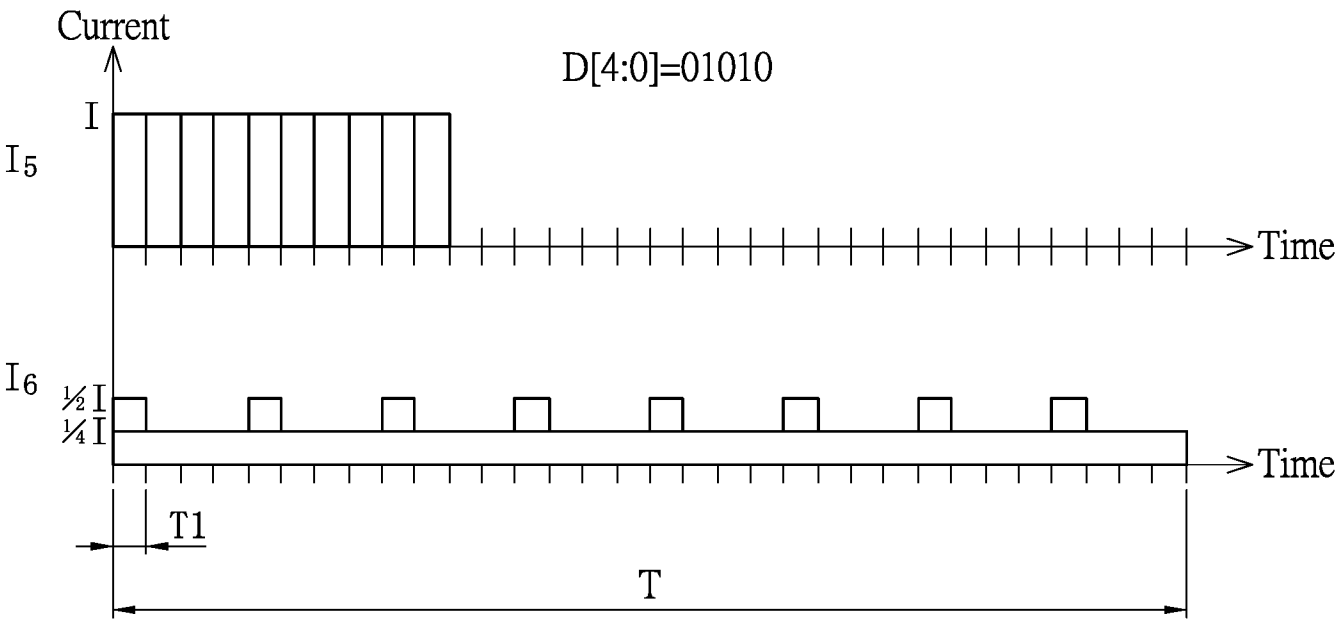
FIG. 7 is a timing diagram illustrating the difference between driving the LED by the driving current based on the grayscale signal D [4:0]=01010 according to the present embodiment and driving the LED by the conventional driving current.

Please refer to FIG. 7. When the grayscale signal is D [4:0]=01010, the conventional current sequence is $I_5$, and the current sequence of the present embodiment is $I_6$. According to the first current I_1 that is set to be $m/(2^k)\times I$, the high bit driving circuit outputs the $1/(2^2)\times I$ current during the grayscale period T because of the value of the high bit signal D [4:3]=1. The value of the low bit signal D [2:0]=2 enables the low bit driving circuit to generate the I/4 current equally driven at eight T1×I time intervals during the grayscale period T. But it is not limited thereto. Compared with the conventional current sequence $I_5$, the product of the driving current value and the turn-on time in the current sequence $I_6$ is 1/4×I×32T1+1/4×I×T1×8=I×T1×10, thus the current sequence $I_5$ and the current sequence $I_6$ have the same luminosity.

Figure 8:
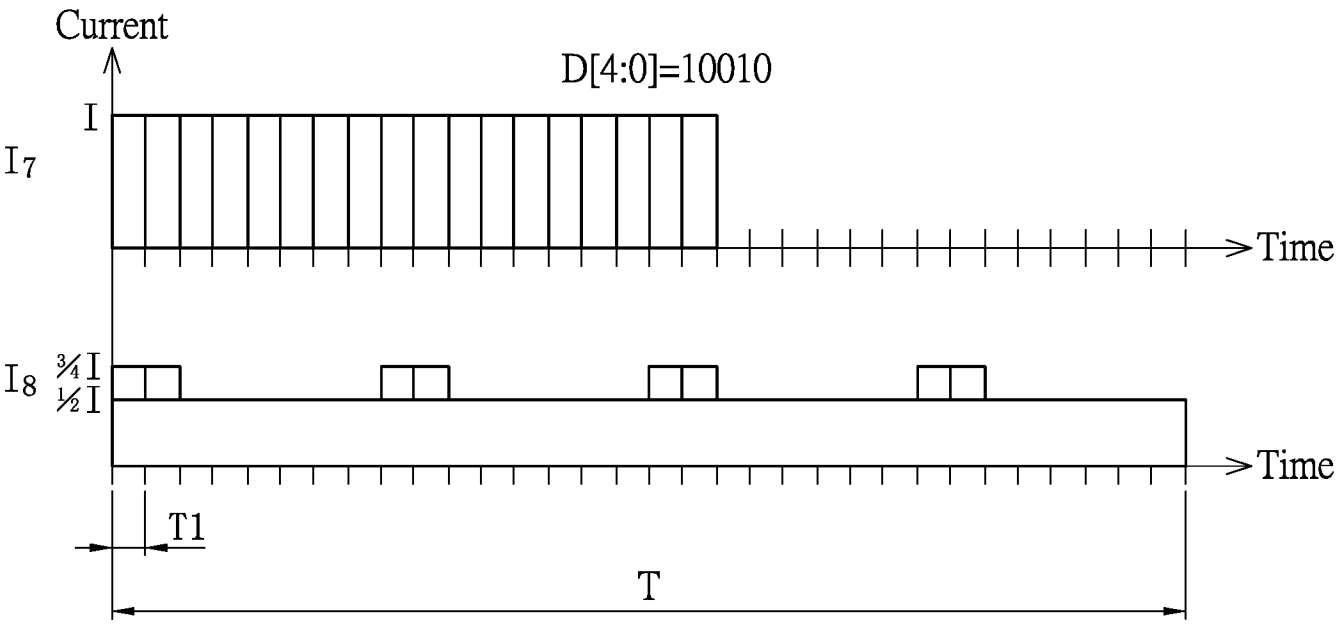
FIG. 8 is a timing diagram illustrating the difference between driving the LED by the driving current based on the grayscale signal D [4:0]=10010 according to the present embodiment and driving the LED by the conventional driving current.

Please refer to FIG. 8. When the grayscale signal is D [4:0]=10010, the conventional current sequence is $I_7$, and the current sequence of the present embodiment is $I_8$. The high bit driving circuit outputs the $2/(2^2)\times I$ current during the grayscale period T because of D [4:3]=2. The low bit driving circuit divides the turn-on time into $2^k$ time intervals. In addition, the low bit driving circuit generates the I/4 current equally driven at the four T1×2 time intervals during the grayscale period T because of D [2:0]=2. But it is not limited thereto. Compared with the conventional current sequence $I_7$, the product of the driving current value and the turn-on time in the current sequence $I_8$ is 2/4×I×32T1+1/4×I×2T1×4=I×T1×18, thus the current sequence $I_7$ and the current sequence $I_8$ have the same brightness.

Figure 9:
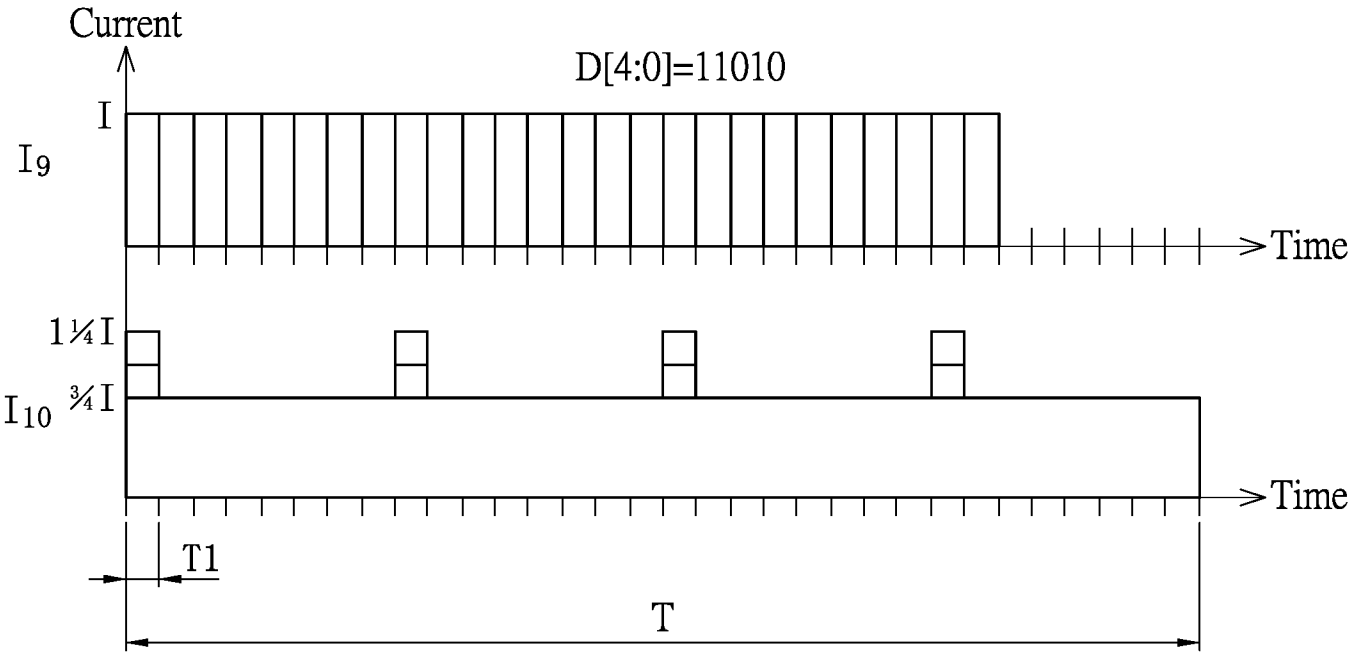
FIG. 9 is a timing diagram illustrating the difference between driving the LED by the driving current based on the grayscale signal D [4:0]=11010 according to the present embodiment and driving the LED by the conventional driving current.

Please refer to FIG. 9. When the grayscale signal is D [4:0]=11010, the conventional current sequence is $I_9$, and the current sequence of the present embodiment is $I_{10}$. The high bit driving circuit outputs the $3/(2^2)\times I$ current during the grayscale period T because of D [4:3]=3, and the low bit driving circuit generates the 1/2×I current equally driven at four T1×2 time intervals during the grayscale period T because of D [2:0]=2. But it is not limited thereto. Compared with the conventional current sequence $I_9$, the product of the driving current value and the grayscale period T in the current sequence $I_{10}$ is 3/4×I×32T1+1/2×I×T1×4=I×T1×26, thus the current sequence $I_9$ and the current sequence $I_{10}$ have the same brightness.

Figure 10:
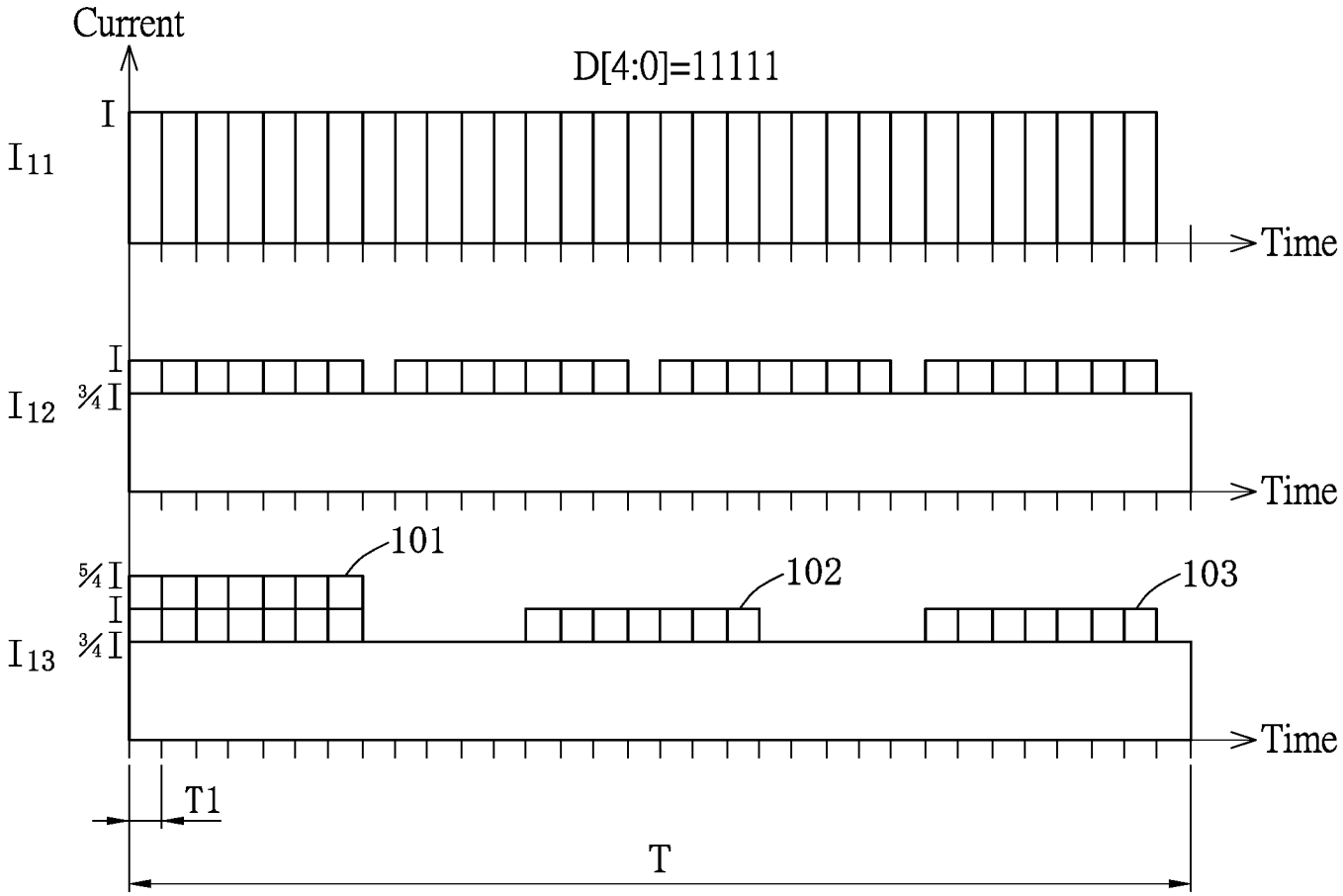
FIG. 10 is a timing diagram illustrating the difference between driving the LED by the driving current based on the grayscale signal D [4:0]=11111 according to the present embodiment and driving the LED by the conventional driving current.

Please refer to FIG. 10. When the grayscale signal is D [4:0]=11111, the conventional current sequence is $I_{11}$, and the current sequences of the present embodiment are $I_{12}$ and $I_{13}$. In the current sequence $I_{12}$, the high bit driving circuit outputs the $3/(2^2)\times I$ current during the grayscale period T because of D [4:3]=3, and the low bit driving circuit generates the 1/4×I current equally driven at four T1×7 time intervals during the grayscale period T because of D [2:0]=7. Compared with the conventional current sequence $I_{11}$, the product of the driving current value and the turn-on time in the current sequence $I_{12}$ is 3/4×I×32T1+1/4×I×7T1×4=I×T1×31, thus the current sequence $I_{11}$ and the current sequence $I_{12}$ have the same brightness. Compared with the current sequence $I_{12}$, the time intervals in the current sequence $I_{13}$ are changed to be three T1×7 time intervals 101, 102 and 103, wherein the current generated by the low bit driving circuit at the first time interval 101 is 2/4×I, and the current generated by low bit driving circuit at both the second time interval 102 and the third time interval 103 is 1/4×I. It is therefore found that the current sequence $I_{12}$ and the current sequence $I_{13}$ have the same brightness.

Figure 11A:
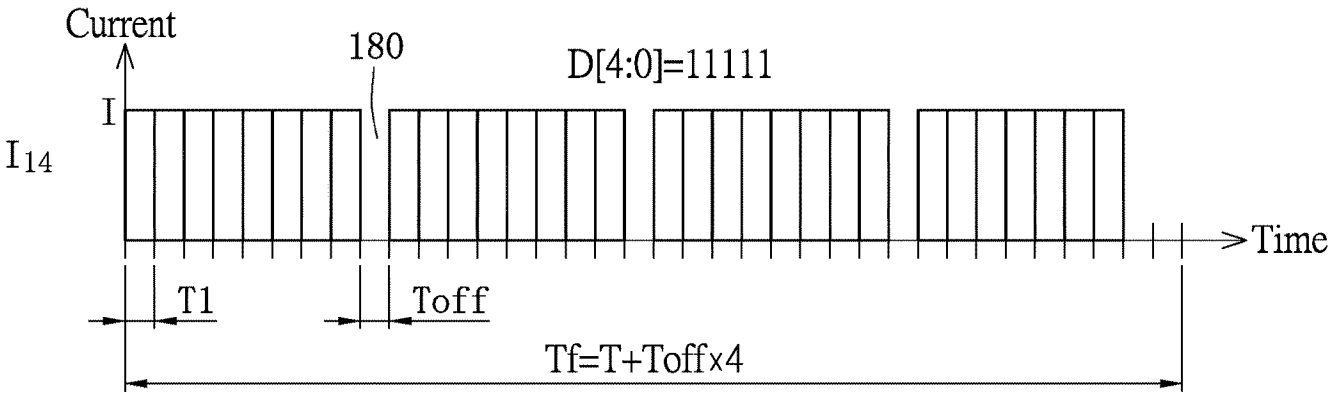
FIG. 11A PRIOR ART
FIG. 11A is a timing diagram illustrating driving the LED by the conventional driving current based on the grayscale signal D [4:0]=11111 and the black insertion signal.

Generally, there is a black insertion Toff generated in the frame period Tf whenever a scan is performed. FIG. 11A shows the conventional current sequence $I_{14}$ that the conventional LED driving circuit outputs 4 black insertion signals 180 (zero current in FIG. 11A) when the grayscale signal is D [4:0]=11111. And the current sequence of the present embodiment is $I_{15}$. The high bit driving circuit outputs the $3/(2^2)\times I$ current during the grayscale period T because of D [4:3]=3, and the low bit driving circuit generates the 1/4×I current equally driven at four T1×7 time intervals during the grayscale period T because of D [2:0]=7. In addition, the driving output terminal outputs a black insertion signal 190 having a time duration Toff (zero current in FIG. 11B) at each time interval of the second current I_2. Compared with the conventional current sequence $I_{14}$, the product of the driving current value and the turn-on time in the current sequence $I_{15}$ is 3/4×I×32T1+1/4×I×7T1×4=I×T1×31, thus the current sequence $I_{14}$ and the current sequence $I_{15}$ have the same brightness.

Figure 11B:
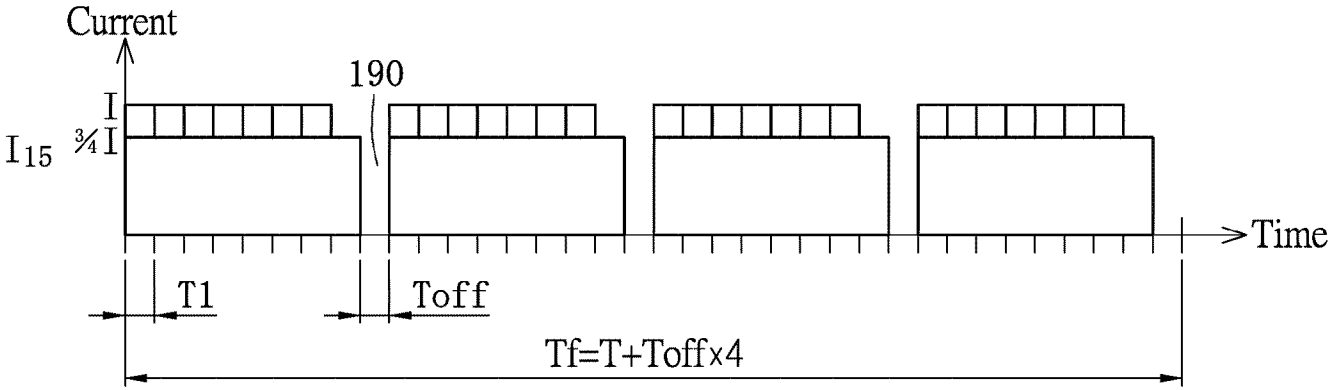
FIG. 11B is a timing diagram illustrating driving the LED by the driving current based on the grayscale signal D [4:0]=11111 according to the present embodiment and the black insertion signal.

In the embodiments of the present disclosure the grayscale period T can be a time duration or a sum of a plurality of time intervals. For example, as shown in FIG. 11A and FIG. 11B, the grayscale period T is divided into a plurality of time intervals by the black insertion signals 180 and 190, but the total time is invariant.

In summary, the LED driving circuit and method of the present disclosure use two driving circuits to respectively process the turn-on time of different data bits to promote the refresh rate in low grayscale. In addition, when the turn-on time of the second current is greater than 1 at each time interval, the LED display can be improved with a higher refresh rate and/or better uniformity in low grayscale and setting the black insertion in the frame period is not interfered with. In other words, the present disclosure drives the LED by lower current and longer drive time, thereby achieving better brightness uniformity in low grayscale by prolonging the drive time in every time interval.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

What is claimed is:

1. A LED driving circuit used to generate a driving current to drive the LED during a grayscale period according to a grayscale signal, comprising:

a high bit driving circuit coupled to a high bit signal of the grayscale signal determining a first current continuously driven during the grayscale period according to a value of the high bit signal of the grayscale signal, wherein the first current is invariant during the grayscale period;

a low bit driving circuit coupled to a low bit signal of the grayscale signal determining a second current driven in at least two time intervals during the grayscale period according to a value of the low bit signal of the grayscale signal; and a driving output terminal coupled to the high bit driving circuit and the low bit driving circuit outputting the driving current added by the first current and the second current;

wherein a ratio of the first current to a constant current is $m/(2^k)$, m is the value of the high bit signal, and k is a bit number of the high bit signal.

2. The LED driving circuit according to claim 1, wherein the grayscale signal has n–bit, n is a positive integer greater than 1, the grayscale period is divided into $2^n$ or $(2^n-1)$ grayscale steps, k is a positive integer smaller than n, wherein the value of the low bit signal is p, the value of the grayscale signal corresponds to a product of the constant current and a time during the grayscale period, the product is $(m\times 2^{(n-k)}+p)\times T1\times I$, I is the constant current, and T1 is the grayscale step.

3. The LED driving circuit according to claim 1, wherein the grayscale signal has n-bit, n is a positive integer greater than 1, the grayscale period is divided into $2^n$ or $(2^n-1)$ grayscale steps, and the product of the second current and the time is p×T1×the constant current during the grayscale period, wherein p is the value of the low bit signal, and T1 is the grayscale step.

4. The LED driving circuit according to claim 1, wherein a ratio of the second current to the constant current is $1/(2^k)$.

5. The LED driving circuit according to claim 4, wherein the total turn-on time of the at least two time intervals of the second current is the value of the low bit signal $\times 2^k \times$the grayscale step.

6. The LED driving circuit according to claim 1, wherein the LED driving circuit outputs a black insertion signal between the at least two time intervals.

7. The LED driving circuit according to claim 1, wherein an amount of the at least two time intervals is $2^k$.

8. The LED driving circuit according to claim 1, further comprising: a control circuit configured to transmit the high bit signal to the high bit driving circuit, and to transmit the low bit signal to the low bit driving circuit.

9. A method of driving a LED used to generate a driving current to drive the LED during a grayscale period according to a grayscale signal, comprising:

defining a grayscale signal to be a high bit signal and a low bit signal;

determining a first current continuously driven during a grayscale period according to a value of the high bit signal; wherein the first current is invariant during the grayscale period;

determining a second current driven in at least two time intervals during the grayscale period according to a value of the low bit signal; and outputting the driving current added by the first current and the second current wherein a ratio of the first current to a constant current is $m/(2^k)$, m is the value of the high bit signal, and k is a bit number of the high bit signal.

10. The method according to claim 9, wherein the grayscale signal has n-bit, n is a positive integer greater than 1, the grayscale period is divided into $2^n$ or $(2^n-1)$ grayscale steps, k is a positive integer smaller than n, wherein the value of the low bit signal is p, the value of the grayscale signal corresponds to a product of the constant current and a time during the grayscale period, the product is $(m\times 2^{(n-k)}+p)\times T1\times I$, I is the constant current, and T1 is the grayscale step.

11. The method according to claim 9, wherein the grayscale signal has n-bit, n is a positive integer greater than 1, the grayscale period is divided into $2^n$ or $(2^n-1)$ grayscale steps, and the product of the second current and the time is p×T1×the constant current during the grayscale period, wherein p is the value of the low bit signal, and T1 is the grayscale step.

12. The method according to claim 9, wherein a ratio of the second current to the constant current is $1/(2^k)$.

13. The method according to claim 12, wherein the total turn-on time of the at least two time intervals of the second current is the value of the low bit signal $\times 2^k \times$the grayscale step.

14. The method according to claim 9, further comprising: outputting a black insertion signal between the at least two time intervals.

15. The method according to claim 9, wherein an amount of the at least two time intervals is $2^k$.

16. A LED driving circuit used to generate a driving current to drive the LED during a grayscale period according to a grayscale signal, wherein the LED driving circuit adjusts an initial current value of the driving current according to a high bit signal of the grayscale signal and increases the driving current in at least two time intervals according to a low bit signal of the grayscale signal to enable the driving current to be greater than the initial current value in the at least two time intervals; wherein the initial current value is ≥0;

wherein the initial current value is a first current determined by the high bit signal, the low bit signal determines a second current, and the driving current in the at least two time intervals is a summation of the first current and the second current; and wherein a ratio of the first current to a constant current is $m/(2^k)$, m is a value of the high bit signal, and k is a bit number of the high bit signal.

17. The LED driving circuit according to claim 16, wherein the LED driving circuit outputs a black insertion signal between the at least two time intervals.

* * * * *